United States Patent [19]

Demny et al.

[11] Patent Number: 4,886,121

[45] Date of Patent: Dec. 12, 1989

[54] UNIVERSAL FLEXBOWL WELLHEAD AND WELL COMPLETION METHOD

[75] Inventors: Albert C. Demny; J. Matt Harwell; Reggie H. Etheridge; Robert E. Bush, all of Houston, Tex.

[73] Assignee: Seaboard-Arval Corporation, Houston, Tex.

[21] Appl. No.: 279,926

[22] Filed: Dec. 5, 1988

Related U.S. Application Data

[63] Continuation of Ser. No. 139,905, Feb. 29, 1988, abandoned, which is a continuation of Ser. No. 941,784, Dec. 15, 1986, abandoned.

[51] Int. Cl.[4] ..... E21B 23/00; E21B 33/047

[52] U.S. Cl. ..... 166/382; 166/73; 166/85; 166/208; 166/214; 285/39; 285/141; 285/321

[58] Field of Search ..... 166/208, 382, 379, 378, 166/88, 89, 86, 85, 214, 206, 207, 237, 75.1, 73; 285/39, 133.2, 140–144, 321; 29/229

[56] References Cited

U.S. PATENT DOCUMENTS

| | | | |
|---|---|---|---|
| 1,740,590 | 12/1929 | Hartman | 29/229 X |
| 2,035,834 | 3/1936 | Penick et al. | 285/141 X |
| 2,159,401 | 5/1939 | Reetor | 285/142 |
| 3,084,745 | 4/1963 | Floyd | 285/133.2 |
| 3,090,438 | 5/1963 | Rawlins | 166/89 |
| 3,168,337 | 2/1965 | Johnson et al. | 285/133.2 |
| 3,405,763 | 10/1968 | Pitts et al. | 166/214 |
| 3,411,588 | 11/1968 | Hanes | 166/208 |
| 3,415,322 | 12/1968 | Putch | 285/141 X |
| 3,420,308 | 1/1969 | Putch | 285/140 |
| 3,478,822 | 11/1969 | Holbert, Jr. et al. | 166/88 |
| 3,483,606 | 12/1969 | Ethridge et al. | 29/229 |
| 3,902,743 | 9/1975 | Martin | 285/39 |
| 4,469,172 | 9/1984 | Clark | 285/141 X |
| 4,550,782 | 11/1985 | Lawson | 166/382 |
| 4,577,686 | 3/1986 | Milberger et al. | 166/88 X |
| 4,595,063 | 6/1986 | Jennings et al. | 166/382 |

*Primary Examiner*—Hoang C. Dang

*Attorney, Agent, or Firm*—Pravel, Gambrell, Hewitt, Kimball & Krieger

[57] ABSTRACT

A new wellhead housing structure which utilizes identical units of a unique wellhead housing of selected internal diameter and pressure rating. Each wellhead housing utilizes a new flexible bowl ("flexbowl") hanger support ring which may be installed and removed as desired during assembly of the wellhead structure during completion of the well. Each wellhead housing forms an internal circumferential groove to receive the flexible bowl hanger support ring in position to receive and support different kinds and sizes of hangers for casing, protective sleeves, and the like. The flexible bowl support ring is drawn into a contracted position. The contracted support ring will pass through the wellhead housing and is seated by a setting tool. Subsequently, a tubing or casing hanger may be landed upon the support ring and supported by the support ring which serves the same functions as the bowl seat in a conventional wellhead housing. The support ring may be removed by a removal tool.

11 Claims, 8 Drawing Sheets

UNIVERSAL FLEXBOWL WELLHEAD AND WELL COMPLETION METHOD

SPECIFICATION

This is a continuation of U.S. patent application Ser. No. 07/139,905 filed Feb. 29, 1988 now abandoned, which is a continuation of U.S. patent application Ser. No. 06/941,784 filed Dec. 15, 1986 now abandoned.

FIELD OF THE INVENTION

This invention generally relates to apparatus and methods for drilling and completing oil and gas wells wherein blowout preventer pressure control apparatus may be used throughout the drilling and completion operations. This invention more particularly pertains to wellhead apparatus including a plurality of wellhead housings having identical inside diameters and configurations which utilize a unique flexible bowl casing and tubing "bowl" support arrangement to provide full vertical bore access for any selected casing and tubing size and weight combination. The invention may be usefully applied for both onshore and offshore drilling and completions.

BACKGROUND OF THE INVENTION

The practice of drilling through a wellhead employed as a pressure vessel is well known in the art. It has been conventional practice to suspend each different casing size in the wellhead pressure vessel and, with each change in casing size, to cease drilling activity while the pressure controlling blowout preventers are disconnected and removed to allow a wellhead of proper bore size to be installed. After the wellhead is installed the blowout preventer is reinstalled and tested for pressure integrity before allowing the drilling operation to continue.

The well is without blowout pressure control and subject to blowout during such operational sequences in the current art. Any blowout can contribute to costly delays in a drilling program schedule.

While the blowout preventer pressure control apparatus is removed, high pressure and high temperature conditions in the well bore can become extreme, causing destructive gases and fluids to be expelled to the atmosphere. Accordingly, it is highly desirable to maintain pressure control of the well with pressure control devices at all times. The conventional prior art systems cannot provide such continuous pressure control.

Multi-bowl wellheads are also known where successive steps (450 shoulders) are formed within the wellhead to support more than one casing hanger and respective seal assemblies. Such wellheads have been one continuous assembly which accommodates two or more mandrel type casing hanger assemblies. Such wellheads also have been made up of two or more flanged wellhead spools into a single assembly.

In these prior art wellheads the internal diameter of the shoulders are determined by the load bearing requirements for the casing hangers and also the relationship to the passage of a drill bit through the reduced diameter at the shoulders in order to drill holes for casing to be subsequently set and cemented while suspended from that respective shoulder.

Where long casing strings and corresponding heavy weights are involved, the load bearing requirements of the support shoulder is frequently the limiting factor of the internal diameter at the shoulder, thus fixing the minimum I.D. of the wellhead. When the casing weight exceeds the load bearing requirements of a support shoulder, the addition of massive pins, driven support wedges, and multiple radial support screws have been used to supplement load shoulders as a means of extending the casing weight. These arrangements of course require penetration of the pressure vessel housing by these devices. The penetrations must be sealed by an elastomer packing which is much less suitable than metal-to-metal seals, or no penetration to begin with.

An additional advantage of the invention is the provision of metal-to-metal seals in all penetrations of the pressure housing. It is necessary to employ some threaded hold-down pins and alignment pins to actuate seal elements, to hold hangers in position, and to align support ring setting tools. While each of these types of pins have elastomer seals used during actuation, they are also provided with metal-to-metal final closure seals. Accordingly, each penetration of the pressure housing is sealed metal-to-metal providing a greater measure of pressure integrity.

As a further advantage, the invention provides structure to convert the drilling wellhead assembly into a well completion system. The conventional well completions employ successively smaller bores and higher pressure rated casing and tubing spools with corresponding size and pressure rated blowout preventers. As previously described, the well is left without the important pressure control during each change of the wellhead since the blowout preventer is removed during each installation of the successive wellhead.

The universal system of the present invention provides continuous attachment of the blowout preventer to the top flange connection of the wellhead and thereby provides maximum pressure control throughout the entire drilling and completion operation, including the drilling of holes for the several casing strings.

The universal wellhead structure and system of the present invention includes provision for receiving a multiple or dual tubing hanger assembly which consists of an external primary duplex bowl and a secondary mandrel sub-assembly which allows tubing installation with the multiple hanger in the blowout preventer. Thus the tubing is run in the multiple hanger, landed, and tested before the blowout preventer is removed. Thereafter a crossover adapter permits reduction of the Christmas tree flange to a smaller size, more convenient to remedial operations. The secondary mandrel insert hanger is the unique structure permitting the tubing to be removed and reinstalled for workover purposes.

There is much prior art pertaining to wellhead equipment generally and also pertaining to well drilling and completion operation. There is no presently known prior art which particularly pertains to the apparatus as herein disclosed. *The Composite Catalogue of Oil Field Equipment and Services,* 1984–1985, published by World Oil, Houston, Tex., illustrates such equipment generally.

OBJECTS OF THE INVENTION

One object of the present invention is to provide a universal wellhead system which will improve drilling operational efficiency under continuous pressure control.

Another object of the invention is to ensure a greater degree of safety protection.

Another object of the invention is to provide a more cost effective well completion method or program in terms of men, equipment and the environment.

A further object of this invention is to provide a universal wellhead system which will significantly improve the structure for suspending casing in a multiple wellhead system without reducing the wellhead bore or penetrating the pressure housing with massive support pins.

Yet another object of the present invention is to provide metal-to-metal seals for all penetrations through the wellhead housings and thereby provide a greater measure of pressure integrity.

A further object of the invention is to provide structure to convert the drilling wellhead assembly to a completion system while maintaining the superior structure of the wellhead following the completion of the well.

SUMMARY OF THE INVENTION

The foregoing and other objects and advantages of the invention are provided with a new wellhead housing structure which utilizes identical units of a new and unique wellhead spool or housing of selected internal diameter and pressure rating. Each wellhead housing utilizes a new flexible bowl ("flexbowl") hanger support ring which may be installed and removed as desired wellhead's structure during the drilling of the well, and the installation and cementing of successive strings of well casings.

Each wellhead housing forms an internal circumferential groove to receive the flexible bowl hanger support ring in position to receive in turn and support different kinds and sizes of hangers for casing, protective sleeves, and the like.

The flexible bowl support ring is drawn into a contracted position closely fitted around a mandrel of an installation tool and supported as contracted by two frangible dowel pins extending through holes in the ring into corresponding holes formed in the surface of the mandrel. The contracted supporting ring will pass through the wellhead housing and is positioned by the setting tool in position to radially expand into the housing groove with assistance of alignment pins which are extended through the wall of the wellhead housing to receive corresponding alignment slots formed in a lower skirt of the support ring as attached to the setting tool. The setting tool is rotated with the support ring restrained against rotation by the alignment pins. Rotation of the setting tools shears the frangible dowel pins and the support ring is thereby released to expand into the housing groove. Subsequently, a tubing or casing hanger may be landed upon the support ring and supported by the support ring. The hanger support ring serves the same functions as the bowl seat in a conventional wellhead housing.

As need be, the support ring may be removed by a removal tool having a plurality of spring biased, radially extending, fingers which are slipped through the support ring by the removal tool to expand below the ring. Upward pull on the removal tool will slip the fingers under an external bevel formed on the skirt of the ring. The removal tool is then actuated to cause the fingers to radially contract and thereby contract the support ring clear of the housing groove for removal by the removal tool from the wellhead.

A cleaning tool is provided for cleaning out the wellhead housing groove before the ring is installed and after the ring is removed. The cleaning tool may be inserted into the wellhead housing, expanded into the wellhead groove, rotated to clean the groove, retracted from the groove, and withdrawn from the wellhead housing.

The overall wellhead housing structure is gradually assembled during the steps of completion of the well. The final housing structure may be the same even though the completion steps may vary somewhat according to the needs or desires of the well owner or operator.

The well completion methods will generally include the steps (more or less) of:

(A) a plurality of wellhead housings is installed as a unit with surface casing or conductor pipe previously run and cemented into place within a well bore.

(B) a bowl protector bushing assembly is lowered by the drill bit drill collar assembly into the wellhead housing to be received by alignment pins and locked into place by lock screws, further hole is drilled by the drill bit through the bushing and the drill bit is then withdrawn with the bushing assembly after retracting the alignment and lock screws;

(C) a flexible bowl shoulder support ring is contracted in connection on a running tool and run from a drill pipe into position opposite the groove in the lower housing assembly and into contact with alignment pins, rotated with the support ring being restrained by the alignment pins to shear the ring retainer pins, and allowing the support ring to expand into the housing groove;

(D) a first casing string, connected in suspension from a first casing hanger, is run into the housing assembly by means of a casing hanger running tool until the casing hanger is seated in the first support ring;

(E) the first casing string is cemented into place and the casing hanger running tool is removed;

(F) a casing hanger seal assembly is then placed over the casing hanger by a seal assembly running tool run off well pipe and the running tool thereon removed;

(G) a second bowl protector bushing is run above the first casing hanger assembly from a drill bit drill collar assembly and secured with alignment pins and lock screws, hole is drilled for a second string of casing and the drill bit drill collar assembly with the bushing assembly is removed;

(H) a second support ring is lowered with a running tool into position opposite the groove in the second wellhead housing located above the first wellhead housing and released to set into place within the housing groove;

(I) a second string of casing, suspended in threaded connection from a second casing hanger, is lowered in position with the second casing hanger seated in the second retainer ring, the second casing string is cemented into place and the second casing hanger running tool is thereon removed from the second casing hanger and withdrawn;

(J) a casing hanger seal assembly is lowered by a seal assembly running tool into position over the second casing hanger and locked into place by means of lock screws;

(K) a third support ring is run in on a running tool, located at the groove of a third wellhead housing and supported in registry with alignment pins. The tool is rotated with the support ring restrained by the alignment pins to shear the retainer pins and allow the support ring to expand into position within the groove;

(L) a makeup multiple tubing hanging assembly with a string of tubing suspended in threaded connection is lowered and seated in the third support ring by means of a tubing hanger running tool; the tubing hanger assembly is anchored down by means of lock screws;

(M) the blowout preventer is removed from the wellhead assembly and;

(N) a tubing head adapter is connected onto the third housing assembly.

At least two wellhead housings may be used, one wellhead housing for each successive string of casing or tubing. There are several intermediate steps of pressure testing and the like which may be included among the steps outlined above. The steps of course vary with the number of pipe strings incorporated in the final structure.

DETAILED DESCRIPTION OF A PREFERRED EMBODIMENT

Figure 1:
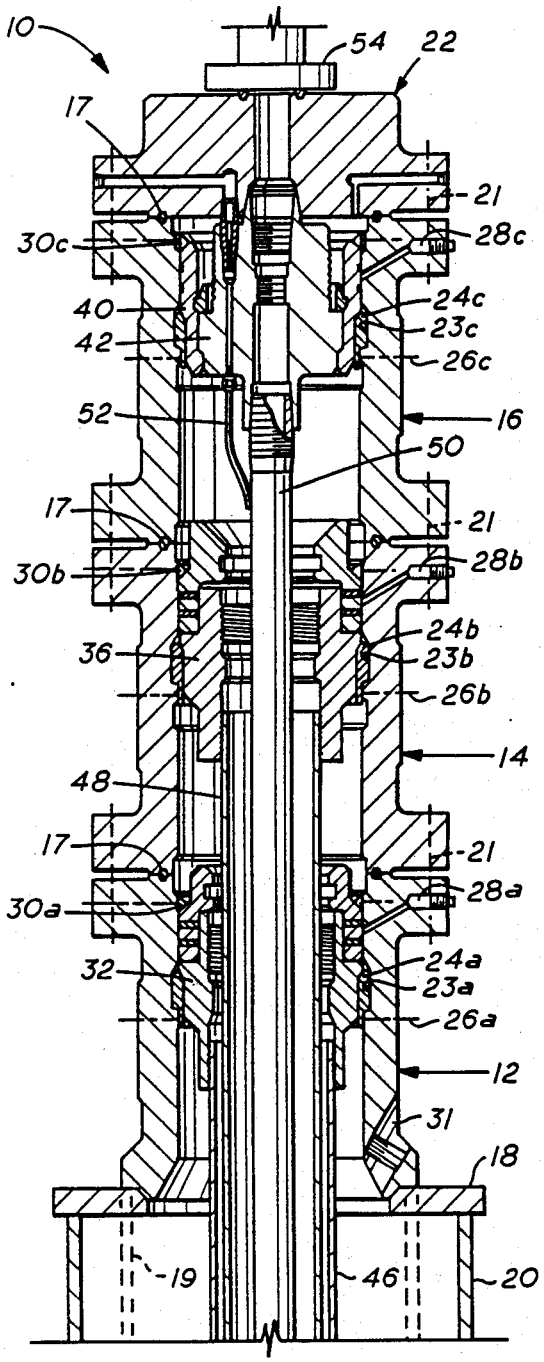
FIG. 1 is an elevational cross-section of the wellhead structure of the present invention.
Figure 2:
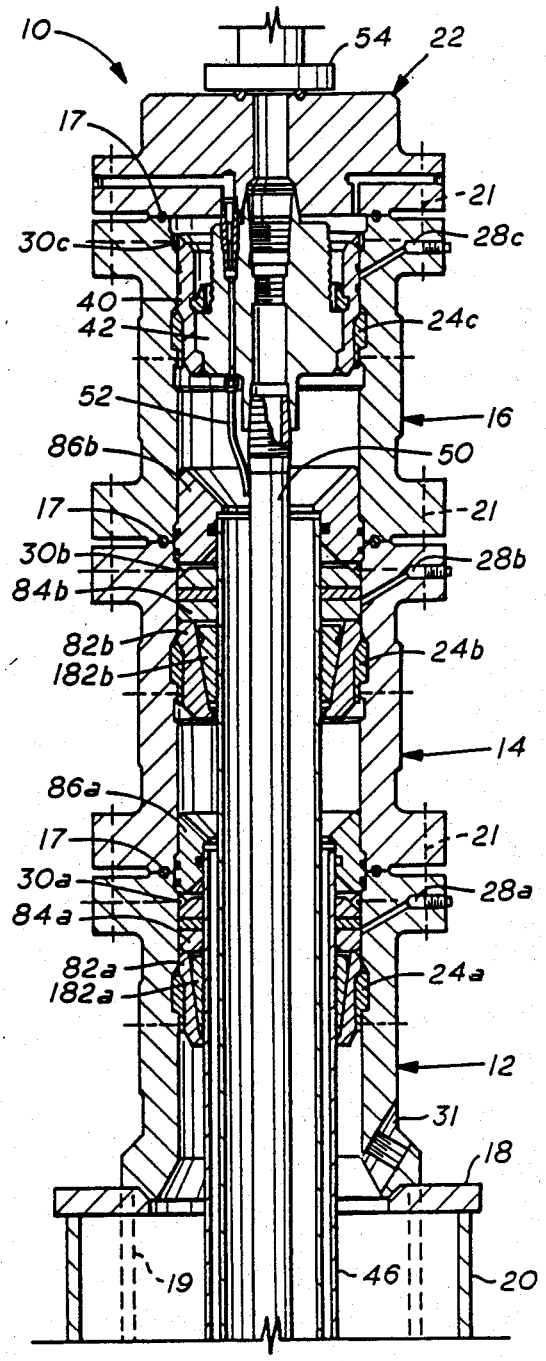
FIG. 2 is a cross-sectional view similar to that of FIG. 1 except that the two strings of casing are supported in suspension by emergency casing slip apparatus rather than by threaded connection as shown in FIG. 1.

FIGS. 1 and 2 show slightly different embodiments of the wellhead assembly, herein referred to as the flexible bowl or universal "flexbowl" wellhead system or apparatus. Please note that threaded mandrel casing hanger assemblies are shown in FIG. 1 and slip-type casing hanger assemblies are shown in FIG. 2. It is also to be noted that actual physical dimensions and values given in this specification are exemplary and are only for description.

Each universal flexbowl wellhead housing 12, 14, and 16 of the wellhead assembly 10 is shop assembled and tested to ensure that the complete wellhead is ready for installation on the surface pipe 19 (shown in dashed lines) or a support base 18 if a larger size pipe 20 is used as shown.

All wellhead housings are constructed of API-type II or III materials in conformance with API 6(*a*). "API" is an abbreviation for American Petroleum Institute. It is noted that spool or housing 12 differs from housing 14 and 16 in that the lower flange has been modified to fit larger sized casing 19 or 20. Also, there is a grout connection 31 in the lower flange of housing 12 giving access to the annulus between the first casing 46 and the outer casing 20 as needed. Internally, all of the housings 12, 14, and 16 are otherwise the same.

Referring to FIG. 1, the wellhead housing 12 is connected to the base 18 as by welded connection, and the base 18 is connected to the outer casing 20 as by welded connection. In the event that a 20" casing is to be used, (such as indicated at 19), then the housing 12 would be welded directly to the casing 19 by appropriate fitting of the spool 12 with the casing 19 and connection by welded connection. The flanged housings (spools) 12, 14 and 16 are connected in stacked relation as shown by means of threaded stud and nut connectors 21 (shown by dashed lines). The housings 12, 14, and 16 are connected in sealed relationship by means of API seal rings 17 fitted into corresponding grooves formed in the flanges. A tubing head adapter 22 is connected by flange connection to the upper housing 16 in the same manner as the housings are connected together.

To the extent described, the wellhead assembly 10 of FIGS. 1 and 2 are identical and like components bear like numbers.

As shown, the housings 12, 14 and 16 have respective grooves 23*a*, 23*b*, and 23*c* formed in the internal diameter to accommodate mounting of flexbowl support rings 24*a*, 24*b*, and 24*c* respectively. The alignment pins 26 are located at 26*a*, 26*b*, and 26*c* respectively on the spools 12, 14, and 16 with two alignment pins being provided for each spool or housing. The alignment pins 26 are shown in detail in FIG. 4.

Figure 3:
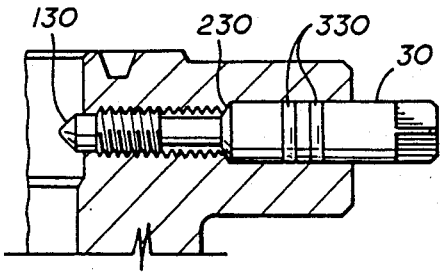
FIG. 3 is a cross-sectional detail view of a typical support screw of the set of support screws provided in each of the wellhead housings shown in FIG. 1 and FIG. 2.

Lock screws 30 are located at points 30*a*, 30*b*, and 30*c* respectively on housings 12, 14, and 16 with such lock screws 30 being shown in detail in FIG. 3. The lock screws 30 are located around the circumference of each flange and serve to lock a component against vertical movement within the housing as later described.

Figure 5:
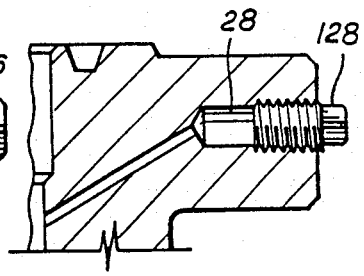
FIG. 5 is a cross-sectional detail of a test port as provided each of the wellhead housings shown in FIGS. 1 and 2.

Test ports 28 are located at 28*a*, 28*b*, and 28*c* as indicated respectively on housings 12, 14, and 16. A detail of test port 28 is shown in FIG. 5.

A grouting connection passageway 31 is formed in the lower part of housing 12 as shown to provide communication from outside into the annulus between casing 46 and casing 20 as needed.

A lower casing hanger 32 is seated in the first support ring 24*a* and supports the first casing 46 in suspension through threaded connection. A second intermediate casing hanger 36 supports the intermediate second casing 48 in suspension through threaded connection as seated in second support ring 24*b*. The third support ring 24*c* supports a primary tubing hanger bowl 40 in seated relation. The hanger bowl 40 supports a secondary tubing hanger 42 which in turn supports a tubing string 50 in threaded connection.

Hydraulic control tubing 52, which has been installed as the tubing is run into the well, is also connected into the tubing hanger 42 and through the tubing hanger into the tubing head adapter 22 for further connection outside the wellhead.

The flange member 54, shown connected at the top of the tubing head adapter 22, may be a production "Christmas Tree" valving arrangement or the like.

The previously mentioned lock screw 30 is shown in FIG. 3. As shown, the lock screw 30 has a weight supporting cone 130, a beveled metal seating shoulder 230 and O-ring seals 330. Until such time as the cone 130 is fully extended, the shoulder 230 is brought into sealing contact with a corresponding counter bore formed in the wellhead housing and the seal formed thereafter is a metal-to-metal seal without danger of leakage.

Figure 4:
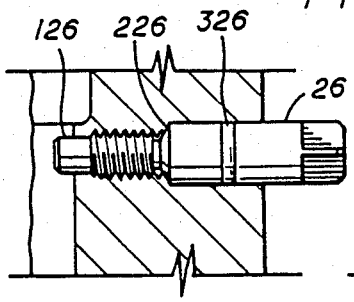
FIG. 4 is a cross-sectional detail view of an alignment pin of the set of alignment pins provided in each of the wellhead housings shown in FIGS. 1 and 2.

The previously mentioned alignment pin 26 is shown in FIG. 4. Alignment pin 26 is shown to include an alignment cylinder 126 extended into the bore of the wellhead housing, a beveled seating shoulder 226 and an O-ring seal 326. As with the lock screw 30, the alignment pin 26 depends on the O-ring seal 326 to provide a seal until the alignment cylinder 126 is fully extended into the wellhead housing bore. The beveled shoulder 226 is then engaged in a corresponding counterbore to effect a metal-to-metal seal of integrity.

FIG. 5 shows the test port 28 located at 28*a*, 28*b*, and 28*c* on housings 12, 14, and 16 respectively. The test port 28 is shown with a threaded plug 128 which can be replaced by a threaded pipe nipple and valve (not shown) if desired.

Figure 6:
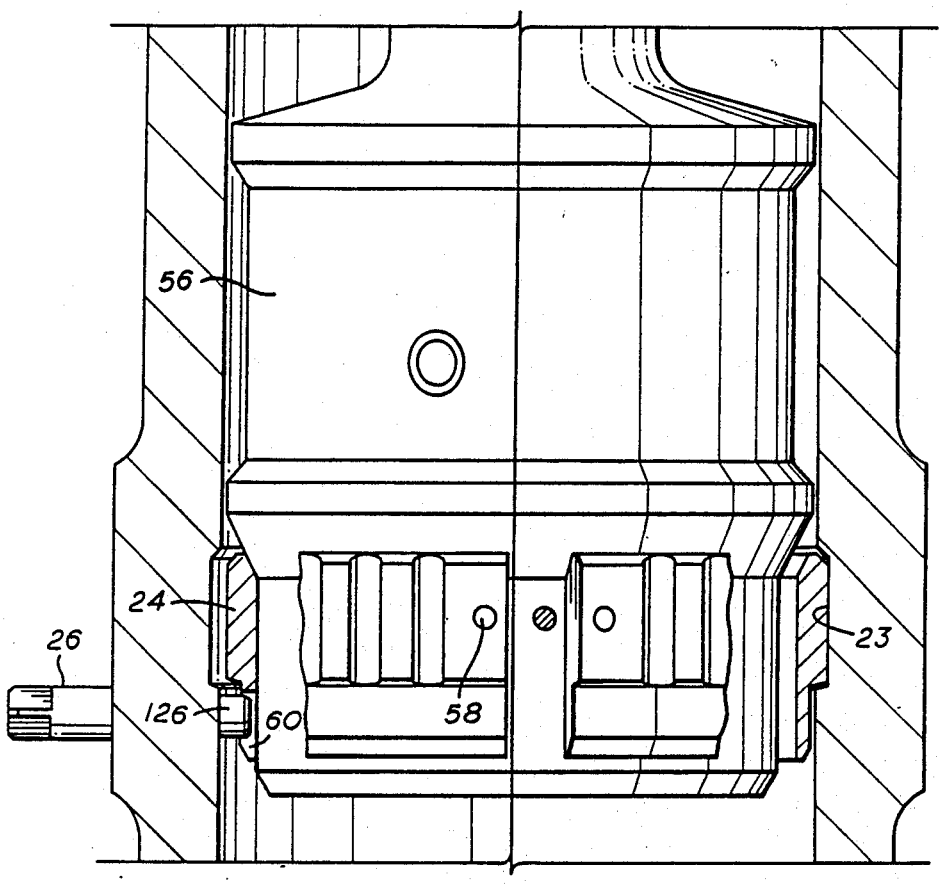
FIG. 6 is a partly elevational and partly sectional view of the support ring running tool carrying a support ring which is mounted in an accommodating groove in each of the wellhead housings shown in FIGS. 1 and 2.

Referring now to FIG. 6, a flexbowl support ring 24 is shown attached to its running tool 56 by means of dowel pins 58. As shown, the support ring 24 is installed on the running tool 56 by compressing the ring into a contracted position such that the dowel pins 58 will pass through corresponding holes in the ring 24 and in the running tool 56 such that the ring 24 will be retained in the contracted position by the pins 58. Ring 24 is formed with two alignment slots 60 which register with the cylindrical end 126 of the alignment pin 26 when the running tool 56 has been lowered and rotated to obtain registry.

Figure 8:
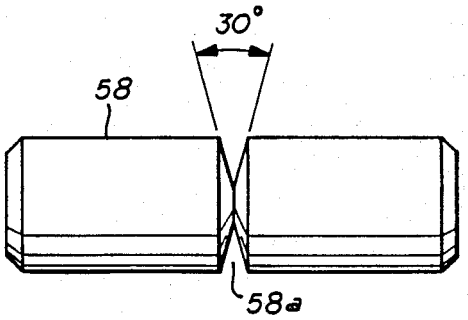
FIG. 8 is a detail view of the shearing dowel pins which hold the support ring contracted on the running tool as shown in FIGS. 6 and 7.

The dowel pins 58 are formed with a central circumferential notch 58*a* of reduced diameter (as shown in FIG. 8) such that rotation of the running tool 56, combined with the rotational restraining action of the alignment pins 26, will cause the dowel pins 58 to shear at the notches 58*a* and thereby release the ring 24 to be expanded into the groove 23 formed in each of the wellhead housings. Once the support ring 24 has been released into its seated position, the running tool 56 may be withdrawn by the drill pipe 64 to which it is attached. The slots 60 are wide enough to allow expansion of the flexbowl ring 24 as described.

Figure 7:
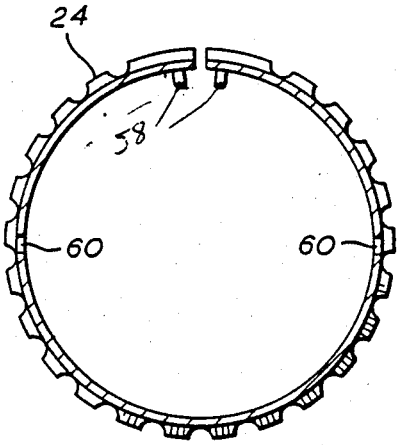
FIG. 7 is a partly sectional view of the support ring as taken at 7—7 of FIG. 6.

FIG. 7 is a cross sectional view of the ring 24 showing its initial attachment to the running tool 56 and its supported registry with the alignment pins 26. FIG. 8 shows the dowel pin 58 in detail with the shear notch 58*a* as previously described.

Figure 9:
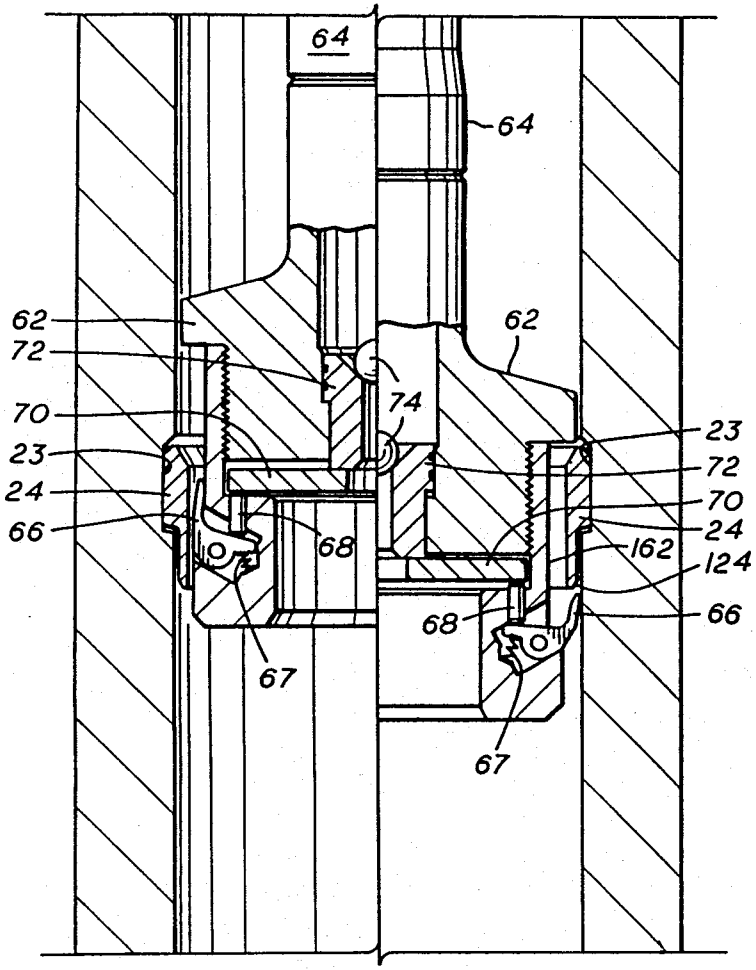
FIG. 9 is a longitudinal, partly sectional, view of the support ring removal tool as positioned just prior to removal of a support ring.

Referring to FIG. 9, there is shown a support ring removal tool 62 attached to a drill pipe 64. At the left of FIG. 9, removal tool 62 is shown as going into a wellhead housing and past a support ring 24 with extraction fingers 66 retained in retracted position. At the right of the drawing, the tool 62 is shown with extraction fingers 66 moved past the support ring 24 and extended radially outwardly and adapted to engage a bevel 124 formed on the lower end of the downwardly extending skirt. The extraction fingers 66 are evenly spaced around the outer circumference of the tool 62. Each finger 66 is pivotedly mounted and biased by a spring 67 toward its extended position. A push rod 68 pushes against the bias of each spring 67 to hold each finger 66 in retracted position as shown to the left of the drawing. The push rods 68 are pushed by a circular transfer plate 70 which in turn is pushed at its center by a slideable piston 72. A closure ball 74 rests over a hole formed through the piston 72 such that when the tool is being lowered, pressure is applied within the drill pipe 64 to push the piston down, the transfer plate 70 down and the pins 68 down to maintain the fingers 66 in retracted position.

As shown at the right of the drawing, when pressure is removed from the drill pipe 64, the springs 67 then push the push rods 68, the transfer plate 70, and the pistons 72 all upwardly and allow the fingers 66 to radially extend into position for retraction as shown at the right of the drawing.

Once the fingers 66 have been extended, the tool 62 is raised to cause the fingers 66 to extend into bevel 124 and behind the skirt of support ring 24 and thereby begin to retract the ring. With the skirt of ring 24 confined by fingers 66, pressure is again applied to piston 74 to further contract ring 24 and thereby clear the ring of the groove 23 for removal.

Pressure reapplied to drill pipe 64 pushes down the piston 72, plate 70 and push rods 68 to compress the spring 67 and retract the fingers 66 which serves to forcefully retract the fingers 66 and further compress the ring 24 into retracted position against the cylindrical surface 162 of the tool 62. Once the support ring 24 is retracted (not shown) the retraction tool and support ring may be completely withdrawn and the support ring 24 later reinstalled by the setting tool 56.

Figure 10:
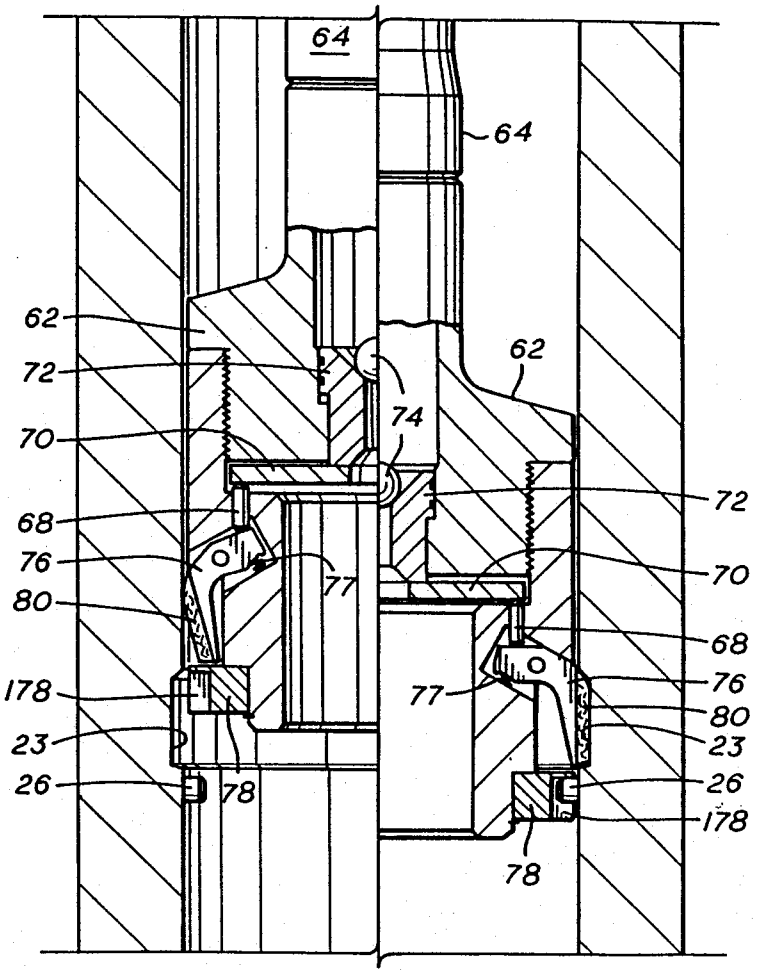
FIG. 10 is a longitudinal, partly sectional, view of a support ring groove cleaning tool before and during a cleaning operation.

Referring now to FIG. 10, there is shown a modification of the extraction tool 62 where like parts bear similar numbers. This modified tool is a cleaning tool serving to clean out the housing groove 23 of a wellhead housing prior to installation, or reinstallation, of a support ring 24. As can be seen, a plurality of cleaning fingers 76 are held in retracted position by springs 77. A steady rest ring 78 is mounted underneath the cleaning fingers 76 to center the tool. Ring 78 is also provided with alignment slots 178 to engage the alignment pins 26 and thereby form a steady rest bearing as the tool 62 is being rotated.

Pressure applied through the drill pipe 64 pushes down the piston 72, the transfer plate 70, and the push rods 68 to overcome the bias of spring 77 and extend the cleaning fingers 76 out into the grooves 23. Each of the fingers 76 mounts an abrading or wire brushing member 80 which serves to clean the groove 23 as the drill pipe 64 and the body 62 are being rotated and with the ring 78 providing stationary stability.

At the end of the cleaning operation, pressure is removed from drill pipe 64 and the springs 77 push the fingers 76 back into retracted position and move the push rod 68, plate 70 and piston 72 back to an upward position. The tool thereon may then be removed and a support ring 24 subsequently installed as described with reference to FIG. 9.

Referring now to FIG. 2, it is seen that the wellhead assembly 10 is the same as the assembly of FIG. 1 with exception of the casing hangers **82*a*, and 82*b*, the casing hanger seals 84*a*, and 84*b*, and the secondary seal assemblies 86*a* and 86*b*. The hangers 82*a* and 82*b* each carry corresponding tapered casing slips 182*a* and 182*b***. These slip type casing hangers are termed "emergency" casing hangers in that the casing may be cut and installed without threads being cut into the casing and without the hangers being of a corresponding threaded type.

OPERATION OF THE PREFERRED EMBODIMENT

The following description is made with reference to FIGS. 11–25 and describes the wellhead assembly 10 as illustrated in FIG. 1 with reference to a well being completed along with assembly of the wellhead structure 10 as illustrated in FIG. 1.

In each of FIGS. 11–25, the wellhead structure 10, as completed by a previous step or steps, appears in light lines with the activity or steps being performed and related structure being emphasized by heavier lines. All of FIGS. 11–25 are largely schematic with the detailed structure appearing in FIGS. 1–10, as necessary.

Figure 11:
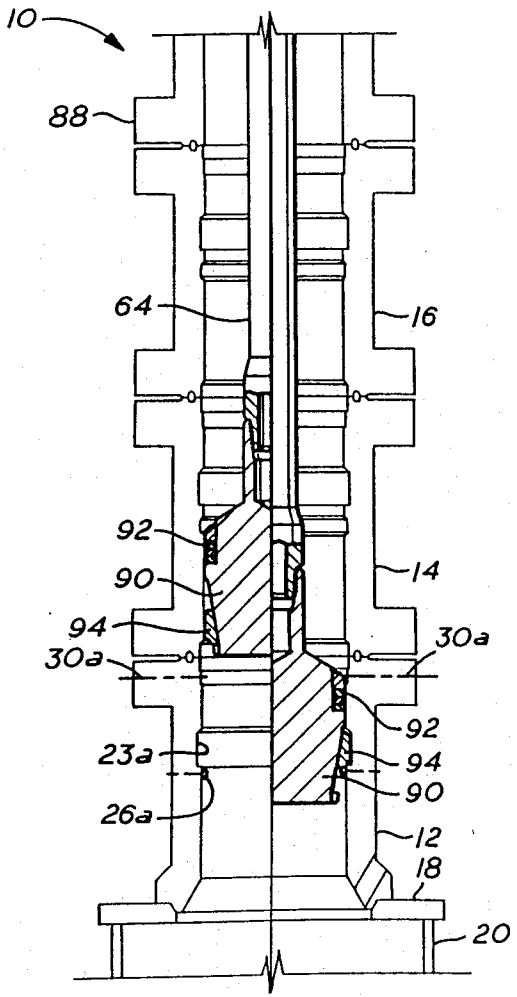
FIG. 11 is an elevational, partly sectional, view of a pressure test plug before and during seating of the plug in the lower housing assembly for pressure tests.

In FIG. 11 the wellhead structure 10 has previously been installed as shown. The flange connected to the upper flange of wellhead housing 16 is representative of a blowout preventer (BOP) 88 through which all the operations described with reference to FIGS. 11–24 are performed in order for the BOP to be ready in the event that wellhead pressure control against a blowout or pressure kicking is needed.

The step of pressure testing the assembly of wellhead housing 12 including the BOP 88 is illustrated in FIG. 11. A test plug 90 carrying a seal assembly 92 and a tapered expandable support ring 94 is run into the wellhead structure 10 from drill pipe 64 until the expandable support ring 94 bears down on alignment pins 26a and until the ring 94 expands into the groove **23*a*. The lock screws 30*a* are then run in against a matching bevel on the plug seal 92** to lock the test plug assembly into place.

Pressure is applied in the annulus between the drill pipe 64, the blowout preventer 88 and the wellhead structure 10 to pressure test these structures. On completion of the tests, the lock screws **30*a* are retracted and the drill pipe and test plug 90** are simply pulled up and withdrawn.

Figure 12:
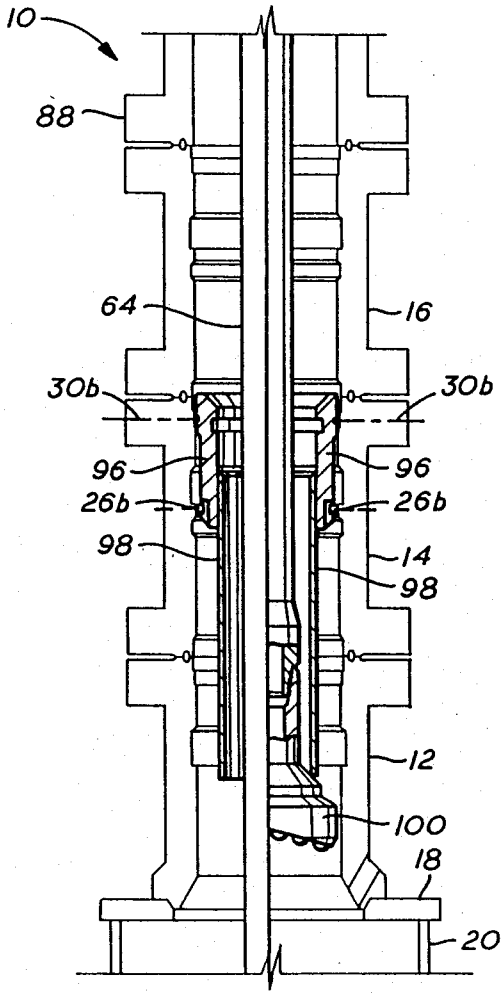
FIG. 12 is an elevational sectional view showing a bowl protector wear bushing installed to protect the housing assembly during further drilling of the well.

FIG. 12 illustrates the step of installing a wear bushing so that drilling may be continued through the wellhead structure 10. A wear bushing assembly 96 including an elongated wear bushing 98 is placed around drill pipe 64 and above a drill bit 100. The wear bushing assembly 96 is formed with accommodating slots to receive the alignment pins **26*b* located in the wellhead housing 14. The wear bushing 96 is seated on the alignment pins 26*b* to present a groove to receive the lock pins 30*b* which are carried by the wellhead housing 14**.

The lock screws **30*b* are screwed into anchor the bushing assembly 96 and drilling is continued in the well. Should the bit 100 need to be replaced, the bushing assembly 96 is released and, when the drilling is completed, the bushing 96** is released and removed.

Figure 13:
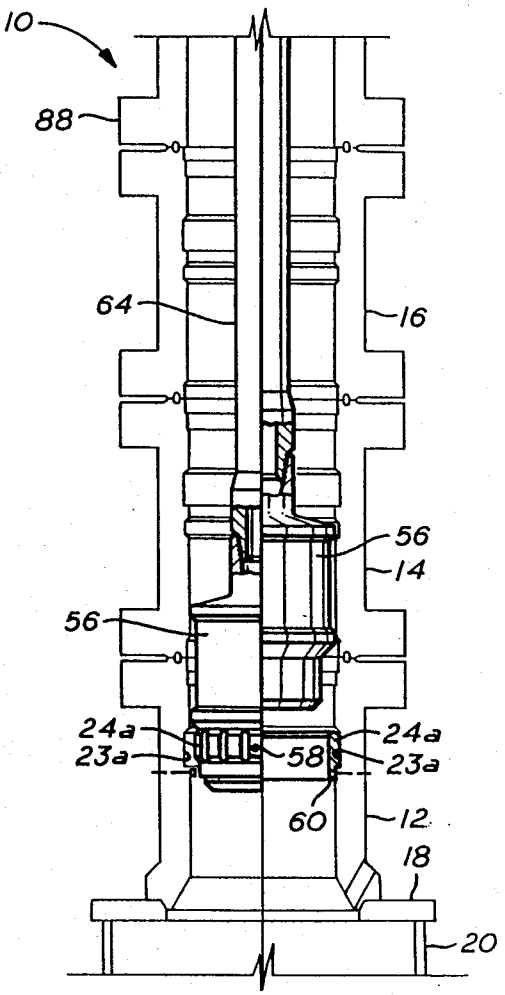
FIG. 13 is an elevational sectional view showing the support ring running tool being withdrawn from the wellhead housing after the support ring has been placed.

FIG. 13 illustrates the next step of installing the flexbowl support ring **24*a* in the groove 23*a* of housing 12 to thereby create a hanger bowl for a casing hanger. A ring running tool 56 carrying an attached and contracted support ring 24*a* is run into the housing 12 until the grooves 60 of the support ring 24 come into supporting registry with the alignment pins 26*a***.

The drill pipe 64 and the running tool 56, are rotated generally to the right until the dowel pins 58 are sheared and the support ring **24*a* expands into seated position within the groove 23*a***. The running tool is then withdrawn.

Figure 14:
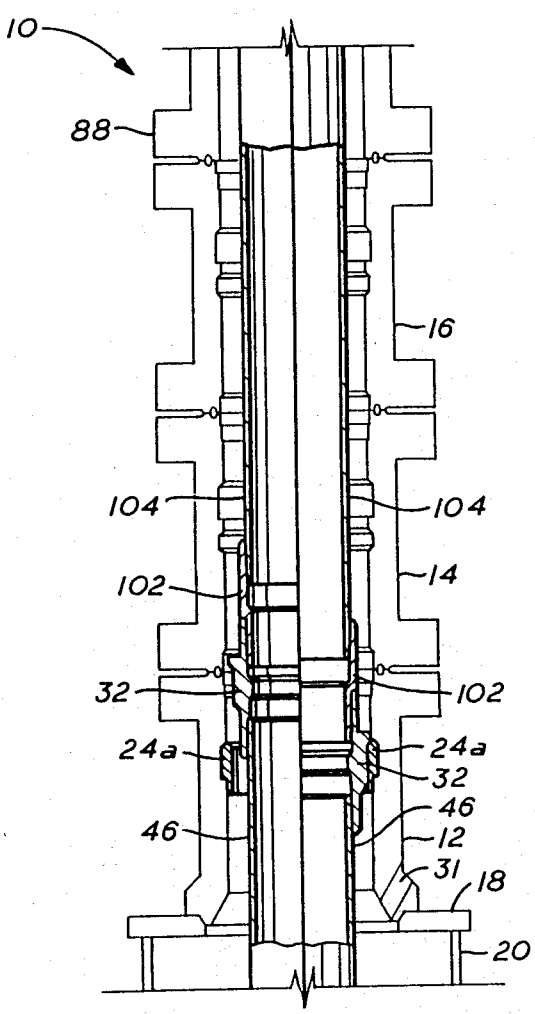
FIG. 14 is an elevational sectional view showing a mandrel type casing hanger with a first string of casing in threaded connection just before and after being seated in the first support ring.

FIG. 14 illustrates the step of running the first casing string 46 into the well until the casing hanger is supported from the support ring **24*a*. The first casing 46 may be 10¾" casing, for example. A casing hanger 32 is threadedly connected to the upper end of the casing 46 and is in threaded connection with a casing hanger running tool 102 connected from a casing 104. The casing 46 is run into the well until the casing hanger 32 is seated in the support ring 24*a*. The casing 46 is then cemented into place through the casing 104 and, when the cement has been displaced out of the casing 46, allowed to set up, and pressure tested, then the casing hanger running tool 102 is rotated to the left to disengage the running tool from the casing hanger 32 and withdrawn. If necessary, the casing string 46 may be cemented to the conductor string 20 by applying grout (e.g. cement) through the grouting port 31**.

Figure 15:
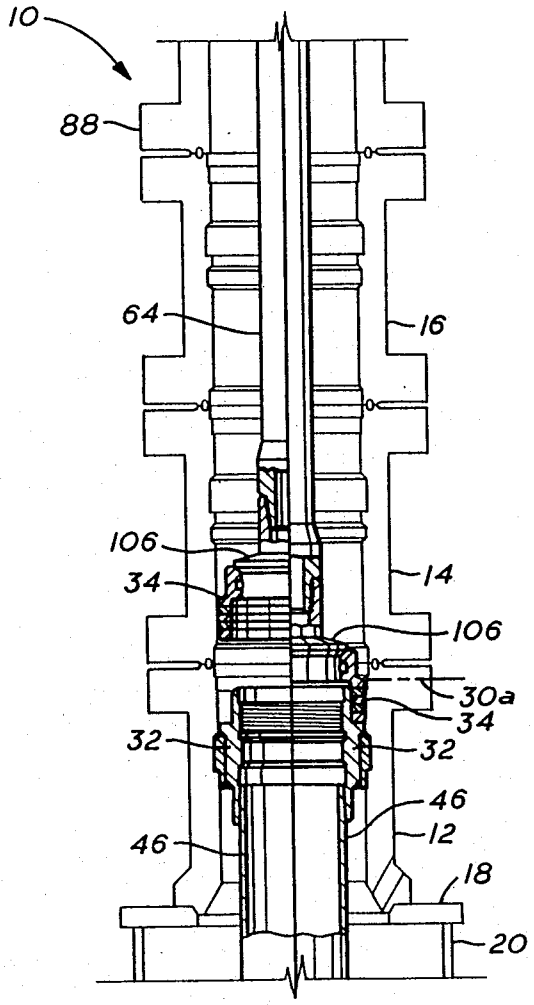
FIG. 15 is an elevational sectional view showing a seal assembly running tool before seating a casing hanger seal assembly; then before being withdrawn from the wellhead assembly.

FIG. 15 illustrates the installation of a hanger seal assembly 34 over and around the upper end of the casing hanger 32. A hanger seal running tool 106 connected from a drill pipe 64 and carrying the casing hanger seal assembly 34 is lowered onto and into sealing position above the casing hanger 32 and locked into place by a means of lock screws 30*a* seated against an accommodating bevel provided on the hanger seal assembly. The running tool is rotated 90' to the left and withdrawn, leaving the sealing assembly installed. The lock screws 30*a* lock the entire assembly into position.

Figure 16:
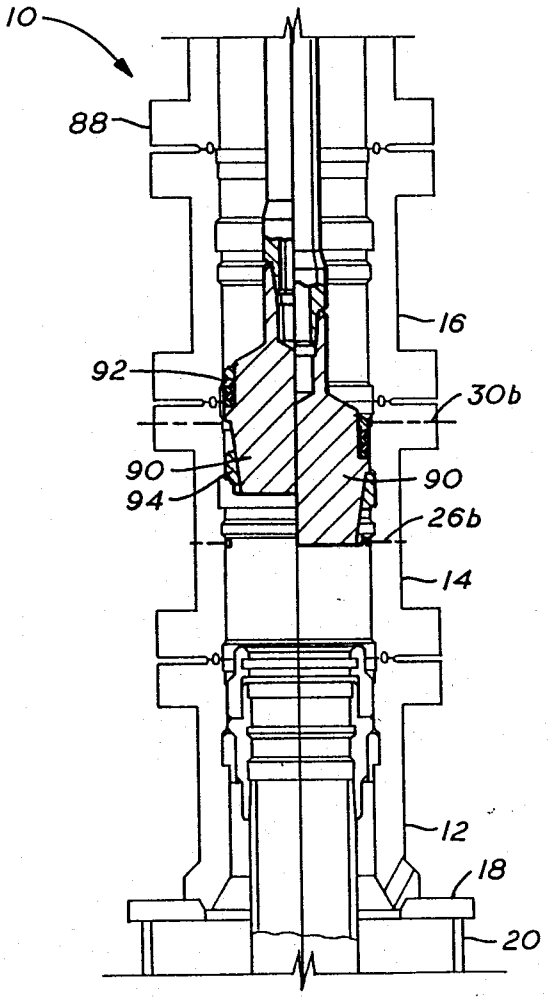
FIG. 16 is similar to FIG. 11 in showing a test plug in position for a pressure test, then being withdrawn.

FIG. 16 illustrates the step of again pressure testing the wellhead structure 10 and BOP stack 88 after installation of the first casing string 46. Here the test plug 90, and the procedure followed, is the same as previously described with reference to FIG. 11. In this instance, the lock screws 30*b* are retracted to permit removal of the test plug 90 and the alignment pins 26*b* are left in place.

Figure 17:
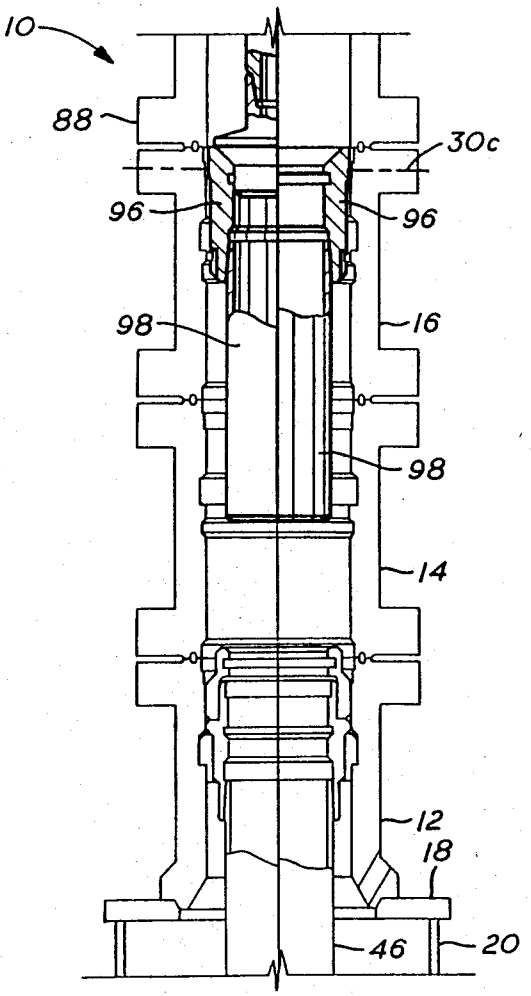
FIG. 17 is an elevational sectional view showing the seating of a wear bushing similar to the bushing shown in FIG. 12.

FIG. 17 illustrates the step of installing the bowl protector bushing assembly 96 as previously described with reference to FIG. 12. In this instance the same wear bushing assembly is employed, through at times smaller drill bits and drill pipe will require a smaller size wear bushing assembly. After installation of the wear bushing 96, a drill bit and drill pipe (not shown) is passed through the drill pipe bushing assembly 96. Drilling is then continued to a desired depth and pay zone, then the drill pipe and bit are withdrawn from the well along with the bowl protector bushing 96 as previously described.

Figure 18:
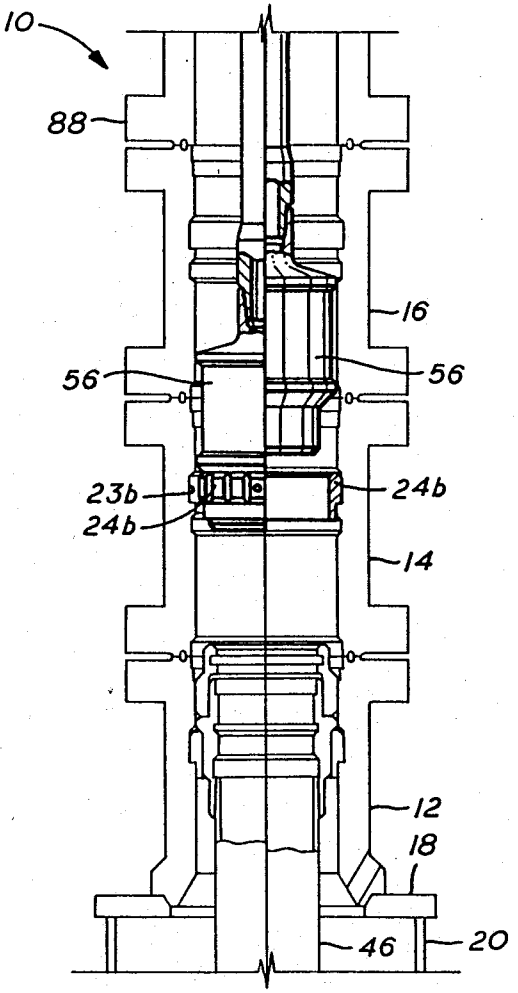
FIG. 18 is an elevational sectional view similar to FIG. 13 and showing a support ring running tool positioning a support ring for release into the housing groove then being withdrawn.

FIG. 18 illustrates the installation of support ring 24*b* into housing groove 23*b* of wellhead housing 14. The installation of support ring 24*b* as shown in FIG. 18 is the same as previously described for the installation of support ring 24*a* in FIG. 13.

Figure 19:
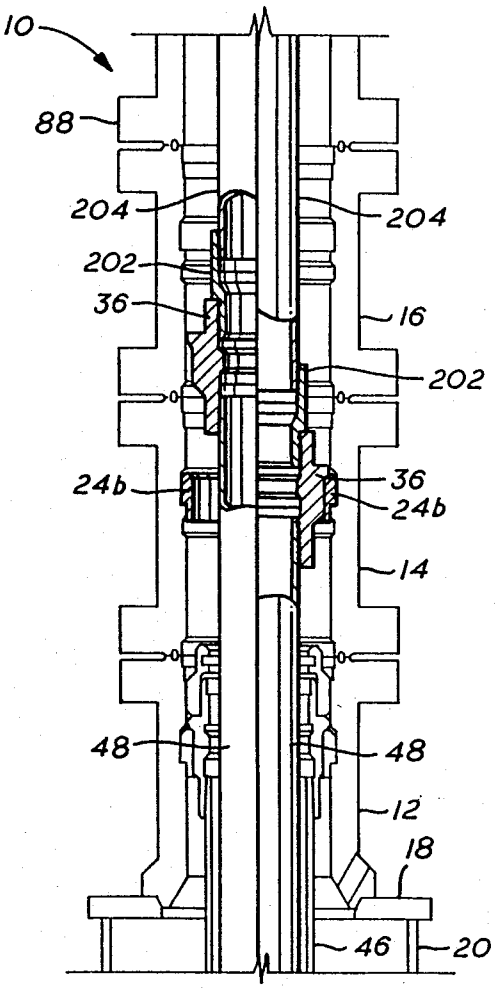
FIG. 19 is an elevational sectional view similar to FIG. 14 and showing a casing hanger running tool carrying a casing hanger into position with the casing hanger being in threaded connection with a second string of casing.

FIG. 19 illustrates the running of the second casing string 48 as suspended from hanger 36 and the seating of casing hanger 36 into flexbowl support ring 24*b* with setting tool 202 and casing 204. This installation is the same as shown for first casing string 46 and casing hanger 32 as previously described with reference to FIG. 14. After installation, the second casing string 48 is cemented and the casing hanger running tool 204 is thereafter removed.

Figure 20:
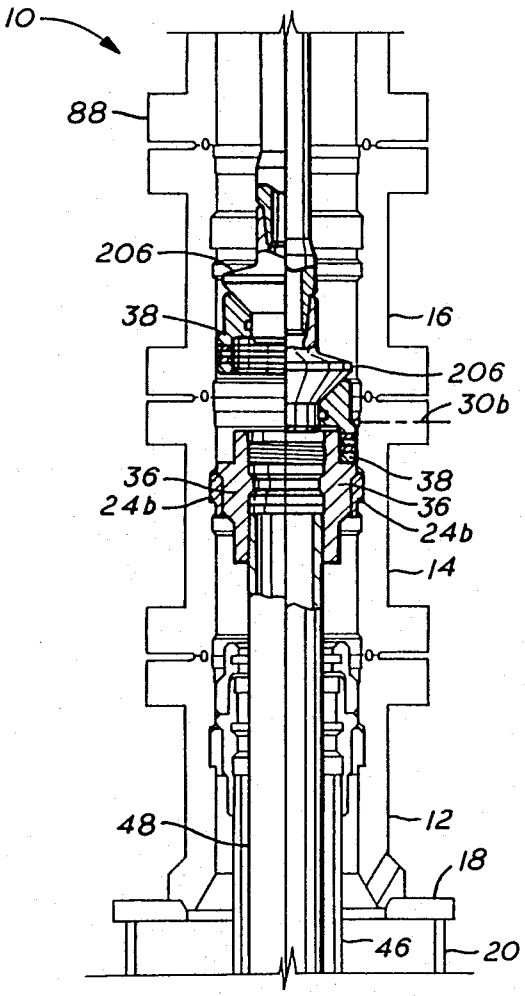
FIG. 20 is an elevational sectional view similar to FIG. 15 and showing a seal assembly running tool placing a casing hanger seal assembly on the second casing hanger.

FIG. 20 illustrates the step of installing the casing hanger seal assembly 38 onto the casing hanger 36. The manner of installing this casing hanger seal assembly 38 from tool 206 in FIG. 20 is the same as previously described for casing hanger seal assembly 34 and tool 106 in FIG. 15. The lock screws 30*b* lock the entire assembly into place.

Figure 21:
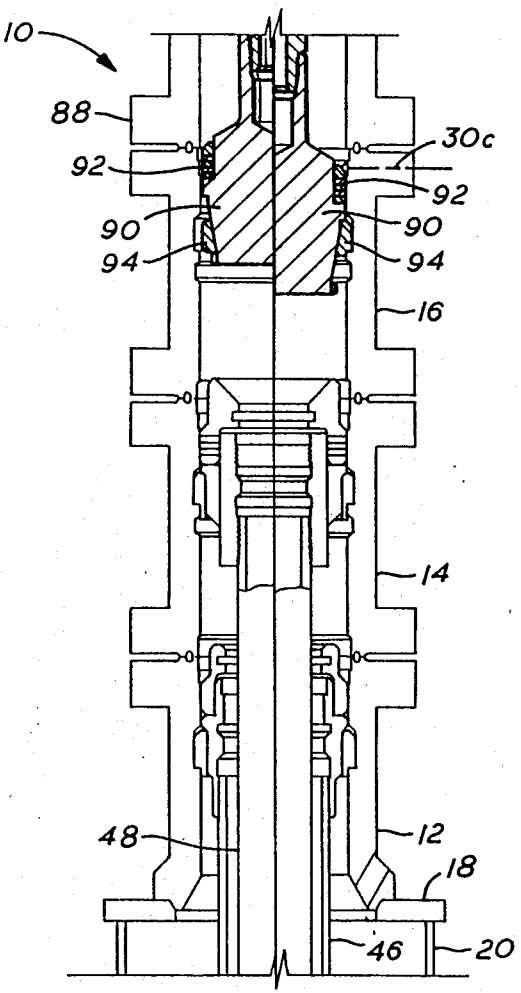
FIG. 21 is an elevational sectional view similar to FIGS. 11 and 16 and showing a test plug as used for pressure testing.

FIG. 21 illustrates the insertion and locking of the test plug 90 into the upper housing 16, pressure testing the housing and the BOP stack assembly 88, and removal of the test plug. This procedure is the same as previously described with reference to FIG. 11 and FIG. 16.

Figure 22:
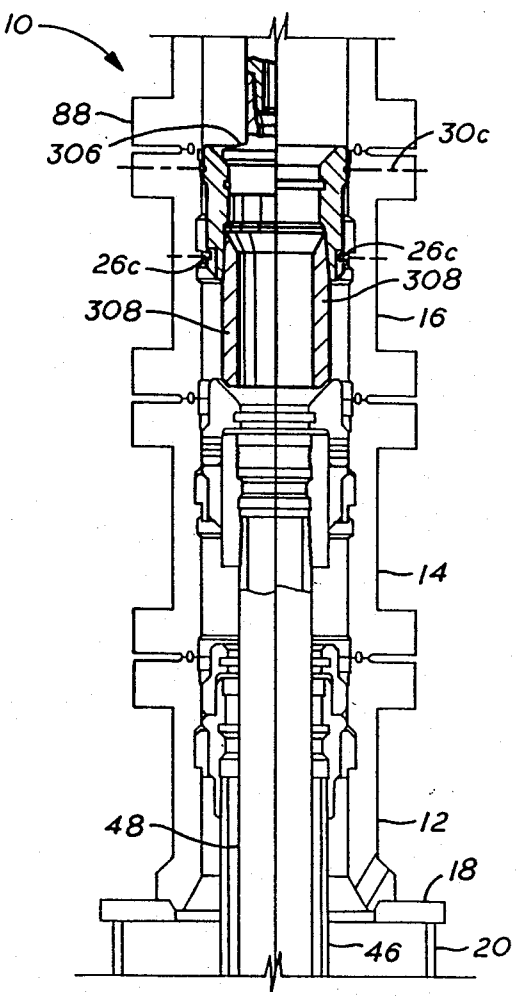
FIG. 22 is an elevational sectional view showing a bowl protector bushing assembly being installed to protect the welhead housing while drilling out cement left in the second casing string.

FIG. 22 illustrates the installation of bowl protector bushing assembly 308 preparatory to drilling out cement remaining in the second casing string 48, logging through the casing 48 to ascertain a particular production zone and perforating through casing 48 into such production zone. The installation and removal of the bowl protector bushing assembly 308 with tool 306 is the same as previously described with reference to FIG. 12 and FIG. 17.

Figure 23:
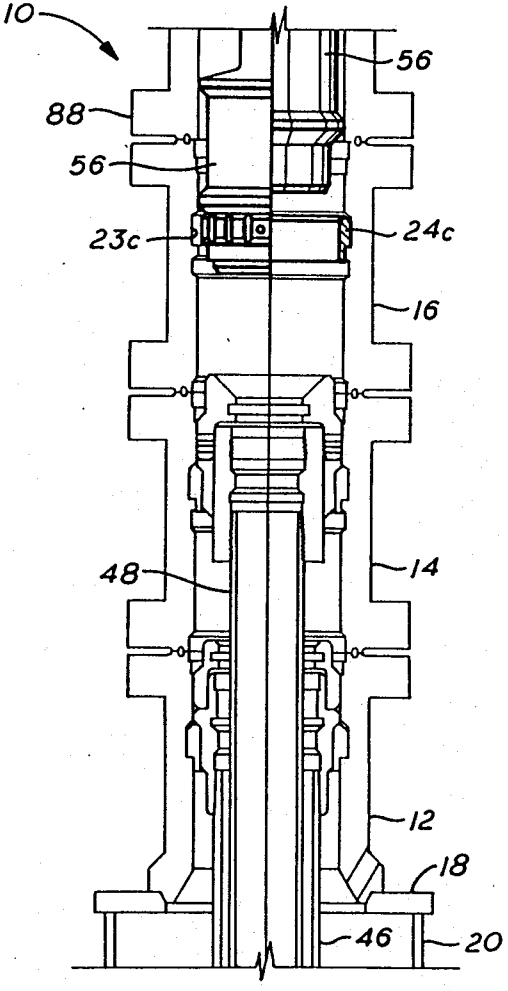
FIG. 23 is an elevational sectional view similar to FIGS. 13 and 18 and showing the support ring running tool during the positioning and installation of the support ring and subsequent withdrawing of the running tool.

FIG. 23 illustrates the installation of support ring 24*c*. The procedure for installing support ring 24*c* is the same as for the installation of support ring 24*a* as described with reference to FIG. 13 and the installation of support ring 24*b* as shown in FIG. 18.

Figure 24:
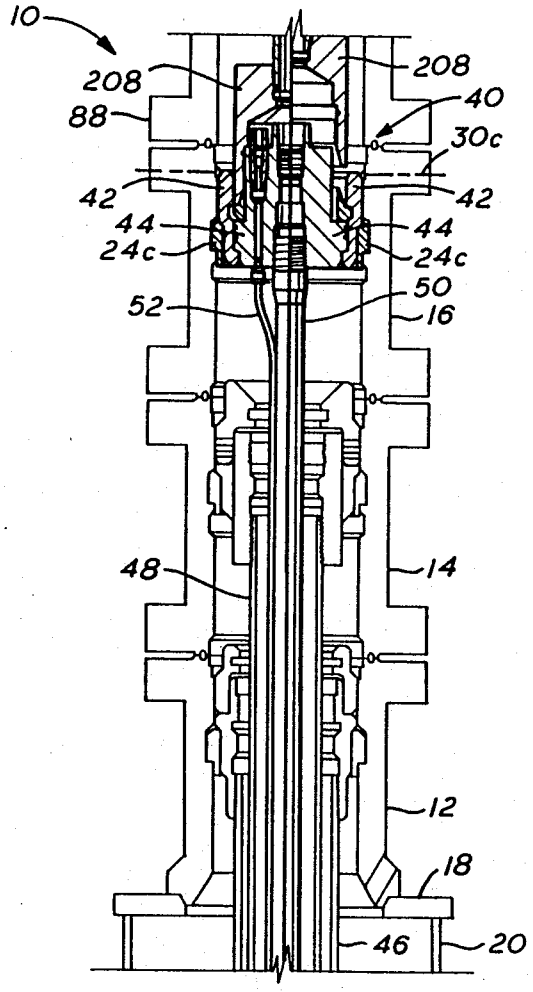
FIG. 24 is an elevational sectional view showing the tubing hanger running tool positioning the tubing hanger from which is suspended a string of tubing in threaded connection.

FIG. 24 illustrates the installation of a string of well tubing 50 as suspended from a tubing hanger assembly 40 including a tubing anchor bowl 42, a secondary tubing hanger mandrel insert 44, and a locking cam ring. The hanger assembly and the hydraulic tubing 52 connected to tubing string 50 is usually run into place after the casing 48 above the perforation into which the lower end of the tubing 50 is fitted. Tubing 50 may also carry a fluid pressure actuated flow control valve (also not shown). Such a control valve will be actuated through a small control line of hydraulic tubing 52 extending up the side of the tubing 50 as shown in FIG. 1 and FIG. 24.

The tubing hanger assembly 40 is suspended from a tubing hanger running tool 208 and seated into place in support ring 24*c* as shown. The control line 52 extending up the side of the tubing 50 is connected into a port in the tubing mandrel insert 44 as shown. After the tubing hanger assembly 40 is seated, the tubing hanger running tool 208 is disengaged by rotating the running tool a prescribed number of turns to the left which disengage the tool from the hanger insert. The running tool is then withdrawn through the BOP stack. The lock screws 30*c* lock anchor bowl 42 into place.

The BOP stack, designated at 88 in FIG. 24, is thereon removed, leaving the upper flange of the wellhead housing 16 open. After the tubing string has been run as illustrated in FIG. 24, there is no further need of the BOP stack 88.

Figure 25:
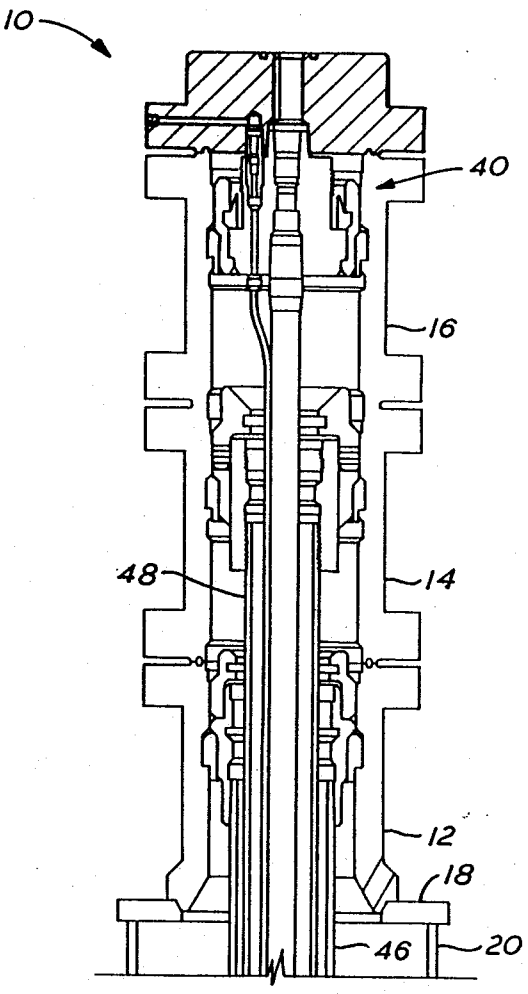
FIG. 25 is an elevational sectional view showing the installation of a tubing head adapter onto the wellhead housing assembly after removal of a blowout preventer to complete the wellhead structure shown in FIG. 1.

FIG. 25 illustrates the installation of a tubing head adapter 22 including the connection of the hydraulic control line through the mandrel insert 44.

The tubing 50 is connected through the tubing mandrel insert 44 and through the tubing head adapter 22 to an outlet suitable for connection into suitable production apparatus.

It is seen that the installation of tubing head adapter 22, as illustrated in FIG. 25, completes the well completion steps as described beginning with FIG. 11. Also completed at this point is the assembly of wellhead structure 10 as illustrated in FIG. 1.

The completion steps involving the emergency slip type casing hangers 82*a* and 82*b* as illustrated in FIG. 2 differ somewhat from those described with reference to FIGS. 11–25 but the same procedure is followed generally.

It is to be noted that certain of the steps as herein described are not necessary to complete the assembly of the wellhead structure as shown in FIG. 1. Other of the steps may be desirable though not essential.

Also to note is that each of the flexbowl support rings 24*a*, 24*b*, and/or 24*c* optionally may be removed and replaced any number of times as needed after the drilling and completing of the well as illustrated and described in FIGS. 11–25 with respect to FIG. 1.

It is to be noted that, while only one embodiment of the present invention has been fully and completely disclosed herein, numerous changes and modifications of this embodiment as disclosed may be made to the invention while remaining within the spirit of the invention and within the purview and scope of the appended claims.

We claim:

1. In a wellhead apparatus adapted for mounting to wellpipe, comprising:

(a) wellhead housing having a generally cylindrical longitudinal bore through which a drill bit on a drill string is adapted to be moved longitudinally;

(b) said bore of said housing having an inside cylindrical surface which has a substantially uniform internal diameter which is large enough for a drill bit and drill string to pass longitudinally therethrough;

(c) said inside cylindrical surface having a first internal cylindrical recess extending longitudinally for a portion of the longitudinal length of the wellhead housing, and having an internal diameter greater than the internal diameter of said inside cylindrical surface of said housing;

(d) a first split support ring made of flexible material which is adapted to be contracted to an external diameter less than said internal diameter of said inside cylindrical surface of said housing but which when released from such contracted position expands by its inherent resiliency to have an external diameter corresponding to the internal diameter of said recess for seating itself in a seated position in said recess, with its inner diameter being less than said internal diameter of said inside cylindrical surface of said housing to provide an upper laterally extending shoulder on said ring which projects into said bore to provide a support for a first pipe hanger or the like;

(e) a running tool having said split support ring releasably secured thereto in the contracted position;

(f) releasable means releasably attaching said split support ring to said running tool for positioning said ring opposite said cylindrical recess and adapted to be severed to release said ring from said running tool; and (g) lock means mounted in the wellhead housing engageable with said split support ring for preventing movement of said ring relative to the wellhead housing, whereby upon movement of said running tool relative to said ring, said releasable means is severed to permit the withdrawal of said running tool from the wellhead housing and the subsequent use of said split support ring as a support for a pipe hanger or the like.

2. The wellhead apparatus of claim 1, wherein:

said releasable means releases said split support ring from said running tool upon a rotation of said running tool relative to said ring.

3. The wellhead apparatus of claim 2, wherein:

said lock means is engageable with said split support ring for preventing rotation of said ring relative to the wellhead housing, whereby upon rotation of said running tool relative to said ring, said releasable means is severed.

4. The wellhead apparatus of claim 1, wherein:

said wellhead housing has an opening through its wall in proximity to said recess;

said lock means comprises a pin which is adapted to extend through said opening in the wall of said wellhead housing; and said split support ring has a slot which is wide enough to receive said pin when the slot is aligned with said pin and the pin is moved in said opening in a direction inwardly toward said bore to thereafter prevent rotation of said ring relative to said housing.

5. The wellhead apparatus of claim 1, wherein:

said wellhead housing has a second internal cylindrical recess positioned above said first internal cylindrical recess which is adapted to receive a second split support ring which extends radially into the bore of said wellhead housing to thereby provide a support for a second pipe hanger and a pipe therewith which is of a smaller diameter than the diameter of a pipe suspended from said first pipe hanger.

6. The wellhead apparatus of claim 1, including:

means to retrieve said first split support ring from the wellhead housing.

7. A method of providing a hanger for well pipe or the like in a wellhead housing, comprising the steps of:

(a) positioning a split flexible support ring in a releasably connected contracted position on a running tool with its outside diameter less than the inside diameter of a wellhead housing in which it is to be mounted;

(b) lowering the running tool with the support ring in the contracted position to a point in the wellhead housing opposite an annular recess in the bore of the housing;

(c) then engaging the support ring with locking means mounted in the wellhead housing while in position opposite the recess to prevent it from moving relative to the wellhead housing; and (d) thereafter moving the running tool relative to the ring to release it from the support ring and to allow the support ring to expand radially outwardly into a seated position in the recess, but with a shoulder on the support ring extending into the bore of the housing to provide a support thereafter for a pipe hanger or the like;

(e) withdrawing the running tool from the wellhead housing; and (f) lowering the pipe hanger into the wellhead housing and seating the hanger on the support ring.

8. The method of claim 7, wherein:

the support ring is engaged with said locking means when opposite the recess to prevent it from rotating relative to the wellhead housing; and the running tool is rotated relative to the support ring to release the ring from the running tool so as to allow the ring to expand radially into the seated position in the recess.

9. The method of claim 8, wherein:

the support ring has a slot therein which is adapted to be aligned with an opening in the wellhead housing.

10. The method of claim 9, including the step of:

inserting a lock pin through said opening for engaging the lock pin in the slot in the support ring to thereafter prevent rotation of the ring relative to the wellhead housing.

11. The method of claim 7, including the step of:

mounting a second split support ring in the wellhead housing for supporting a second pipe hanger or the like.

* * * * *